US005558288A

United States Patent [19]

Brovelli

[11] Patent Number: 5,558,288

[45] Date of Patent: Sep. 24, 1996

[54] YARN BOBBIN CORE TUBES

[76] Inventor: Loredana Brovelli, Via Monte Rosa 21, Milan, Italy, 20100

[21] Appl. No.: 272,395

[22] Filed: Jul. 20, 1994

[30] Foreign Application Priority Data

Jul. 20, 1993 [IT] Italy ..... MI930592 U

[51] Int. Cl.[6] ..... B65H 55/00

[52] U.S. Cl. ..... 242/172; 242/130.2; 242/614

[58] Field of Search ..... 242/172, 159, 242/164, 131, 131.1, 125.1, 125.2, 130.2, 118, 614, 18 EW

[56] References Cited

U.S. PATENT DOCUMENTS

| | | | |
|---|---|---|---|
| 2,197,736 | 4/1940 | Uytenbogaart | 242/125.1 |
| 2,898,054 | 8/1959 | Rea | 242/125.1 |
| 3,032,292 | 5/1962 | Ievinson | 242/125.2 |
| 3,356,312 | 12/1967 | Briggs et al. | 242/164 |
| 4,317,548 | 3/1982 | Rottleb | 242/125.2 |
| 4,598,540 | 7/1986 | Gaudino | 242/18 EW X |
| 4,842,213 | 6/1989 | Bartschi et al. | 242/125.1 |
| 5,085,378 | 2/1992 | Guttler | 242/172 |
| 5,239,814 | 8/1993 | Yamada et al. | 242/131 X |

FOREIGN PATENT DOCUMENTS

| | | | |
|---|---|---|---|
| 510857 | 3/1922 | France | 242/125.2 |

*Primary Examiner*—Michael R. Mansen

*Attorney, Agent, or Firm*—Millen, White, Zelano, & Branigan, P.C.

[57] ABSTRACT

The invention relates to a tubular bobbin core onto which roving or slubbing is wound and which is able to be transported overhead with its axis substantially vertical, suspended by its upper part. In order to avoid unwinding of said roving or slubbing during core transport, said core shows, in a tube portion below the wound area, at least one projecting part which can grip the running end of the roving or slubbing wound on by a winding machine or freely uncoiling from the wound bobbin.

7 Claims, 1 Drawing Sheet

Fig. 1
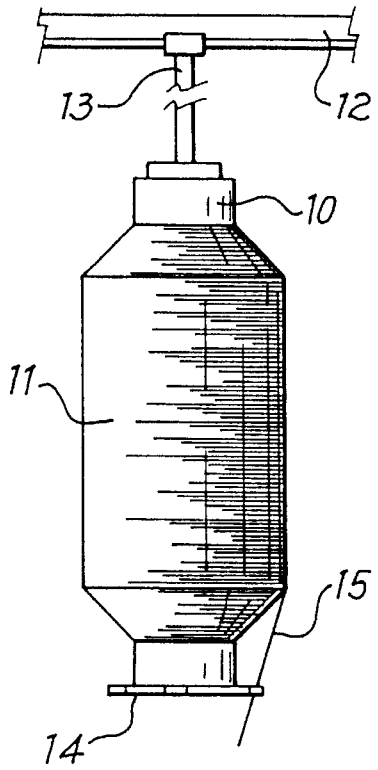
Fig. 2
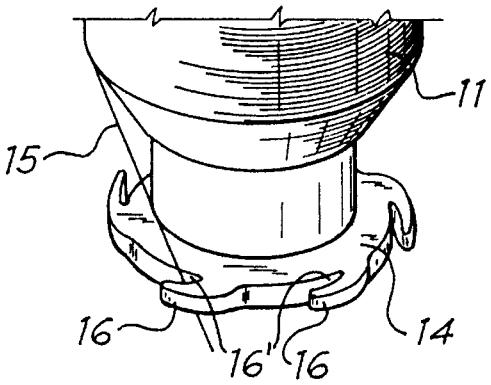
Fig. 3
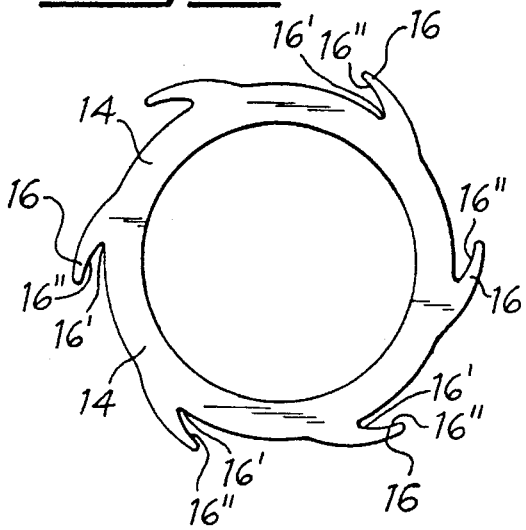
Fig. 4
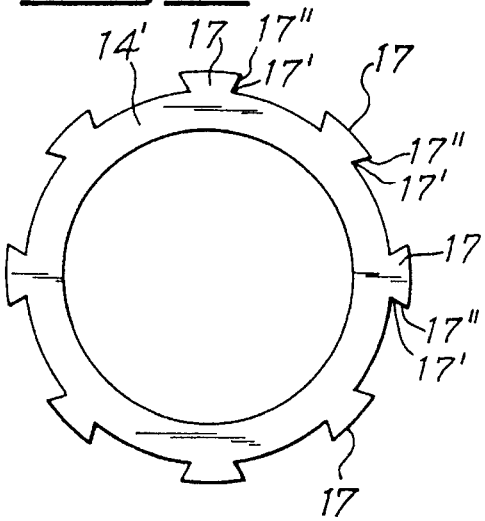
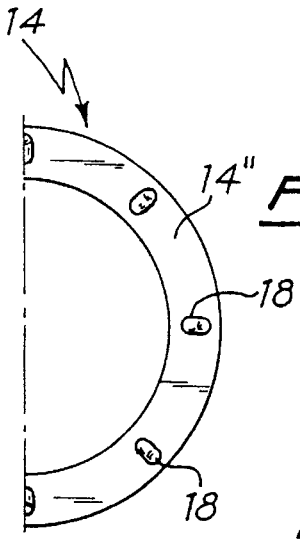
Fig. 5
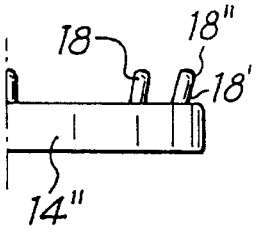
Fig. 5a

YARN BOBBIN CORE TUBES

BACKGROUND OF THE INVENTION

1. Field of the Invention

The present invention relates to tubular cores for yarn bobbins, on which is wound roving or slubbing as the final operation prior to spinning in a manner already known on appropriate machinery.

2. Description of the Prior Art

These bobbins, in the most recent automatic machines, are usually transported from the winding machines to the spinning bays in a suspended condition from overhead rails to which the individual bobbin tubes are hooked, hanging down freely with their axes substantially vertical.

In this position, the running end of the roving or slubbing can fall away from the rest of the bobbin and hang down towards the ground. Under these conditions, such bobbins often uncoil, especially if the hanging running end of the roving or slubbing touches the ground or comes into contact with anything that retains it. In cases where such automated plants are left operating unattended for relatively long periods e.g. over a weekend, a considerable quantity of roving or slubbing can accumulate along the transporter path, resulting in a significant waste of material and in a labour cost of cleaning-up.

3. Objects of the Invention

The present invention proposes a tube of the type used for the purpose stated above, which eliminates the aforementioned drawbacks in a cheap and simple manner, and ensures that the running end of the roving or slubbing is kept on the tube while it is being transported without increasing the work at the end of the winding or the beginning of the unwinding steps.

SUMMARY OF THE INVENTION

According to the present invention, what above is achieved by a tubular core onto which roving or slubbing is wound and which is able to be transported overhead with its axis substantially vertical, suspended by its upper part, characterized in that it shows, in a tube portion below the wound area, at least one projecting part which can grip the running end of the roving or slubbing wound on by a winding machine or freely uncoiling from the wound bobbin.

Said projecting part, generally formed by a ring element with one or more gripping teeth or one or more areas with a high coefficient of friction for the roving or slubbing, may be an integral part of the tube or fitted to it.

The external diameter of such projecting part will be slightly greater than the tube itself if the winding machine is set in such a manner to pull the running end of the roving or slubbing on it, or said diameter will be greater if the projecting part has to catch the end of the roving or slubbing when freely hanging from the bobbin.

BRIEF DESCRIPTION OF THE DRAWINGS

The present invention will now be described in detail with reference to an embodiment thereof as shown in the attached drawings, wherein:

FIG. 1 shows a side elevation of a tube according to the present invention, together with means for retaining the roving or slubbing.

FIG. 2 shows a perspective view of the lower end of the tube according to FIG.1.

FIGS. 3 and 4 show a plan view of possible embodiments of retaining rings to be fitted on existing tubes.

FIG.5 shows partly in plan a further possible embodiment of a retaining ring.

FIG. 5A shows partly in elevation the embodiment in FIG. 5.

DESCRIPTION OF THE PREFERRED EMBODIMENTS

In FIG. 1 a tube 10 with roving or slubbing windings 11 is transported along an overhead rail 12 from which it is suspended by a support 13 in such a way that its axis is substantially vertical. The tube 10 has, either as an integral part or separate addition, a ring component 14 adjacent to its lower end which ring serves to retain the running end 15 of the roving or slubbing.

The ring component 14 may have an outer surface with a high coefficient of friction, but preferably has an externally toothed area which retains the roving or slubbing running end 15 applied to it by the winding machine at the end of the winding stage, as can be seen in FIG. 2.

Whenever the winding machine is not equipped to carry out this final operation, the diameter of the ring component 14 must be such as to ensure an entrapment of the running end 15 of the roving or slubbing as it falls freely from the bobbin windings, i.e. the ring diamater will be of the order of the external diameter of the fully wound bobbin. FIG.3 shows a ring component 14 to be fitted to the lower end of a tube and having saw-tooth projections 16, directed in a direction opposite to the roving or slubbing uncoiling direction.

FIG.4 shows a ring component 14 with projecting isosceles trapezoidal teeth 17 having their larger base facing to the outside, while FIG. 5 shows a ring component 14 with projecting near-vertical studs 18 also directed radially towards the outside.

Considering the invention more specifically, the tubular bobbin core 10 is formed about an axis 20 and has first and second ends 22 and 24. Around the core 10, the roving or slubbing 11 is wound to form a package or wound configuration 26 with frustoconical first and second ends and a substantially cylindrical central portion. A running end 15 extends directly downwardly therefrom and does not overlie the end of the core. When the core 10 with the package 26 is transported, it is transported with the axis 20 oriented vertically and with the running end 15 caught in a notch 17', 16' or 18'. The notches are defined by surfaces such as surfaces 17" or 16" which are oriented at an oblique angle with respect to the direction of the radius of the bobbin drawn from the axis 20. The notches 17' and 16' open away from the direction that roving or slubbing 11 is unwound from the package or wound configuration 26.

I claim:

1. A wound package combination comprising:

a tubular bobbin core formed about an axis and having a first and second end, around which roving or slubbing is wound to form a wound package, wherein the tubular bobbin core is transported normal to the core axis while being suspended at the first core end with the axis oriented vertically and the wound package having a cylindrical central portion and frustoconical first and second end portions spaced from the first and second core ends with a running end portion of the wound roving or slubbing hanging past the second core end; and a means for retaining the running end portion of the roving or slubbing disposed on the second core end and including at least one lateral projection on the second core end extending radially with respect to the axis of the bobbin core, the at least one projection having a surface oriented at an oblique angle with respect to a radius of the bobbin core to define a notch for receiving the running end portion of the roving or slubbing hanging from the wound package and retaining the running end portion at only one location proximate the outer surface of the cylindrical portion of the wound package.

2. The wound package configuration of claim 1, wherein there are a plurality of similar lateral projections extending from a ring fixed to the second end of the bobbin.

3. The wound package configuration of claim 2, wherein the notches formed by the lateral projections open in a direction facing away from the direction which the roving or slubbing moves when unwinding from the bobbin.

4. The wound package configuration of claim 2, wherein the lateral projections are each trapezoidal in shape with wide sides distal from the ring.

5. The wound package configuration of claim 2, wherein the ring is a separate element from the tubular bobbin, which separate element is fixed to the tubular bobbin.

6. The wound package configuration of claim 2, wherein the distance that the projection extends laterally past the bobbin core is slightly less than the radius of the wound configuration.

7. The wound package of claim 6, wherein the running end hangs directly down from the projection and does not overlie the end of the core.

* * * * *